United States Patent [19]

Dusseux et al.

[11] Patent Number: 5,055,852

[45] Date of Patent: Oct. 8, 1991

[54] DIPLEXING RADIATING ELEMENT

[75] Inventors: Thierry Dusseux, Tournefeuille; Michel Gomez-Henry, Toulouse, both of France

[73] Assignee: Alcatel Espace, Courbevoie, France

[21] Appl. No.: 540,737

[22] Filed: Jun. 20, 1990

[30] Foreign Application Priority Data

Jun. 20, 1989 [FR] France ..... 89 08190

[51] Int. Cl.[5] ..... H01Q 1/38; H01Q 13/00

[52] U.S. Cl. ..... 343/725; 343/769; 343/786; 343/846; 333/135; 333/21 A

[58] Field of Search ..... 343/700 MS, 769, 725, 343/767, 786, 789, 829, 846; 333/135, 21 A

[56] References Cited

U.S. PATENT DOCUMENTS

| | | | |
|---|---|---|---|
| 4,089,003 | 5/1978 | Conroy | 343/700 MS |
| 4,138,684 | 2/1979 | Kerr | 343/846 |
| 4,329,689 | 5/1982 | Yee | 343/700 MS |

FOREIGN PATENT DOCUMENTS

| | | | |
|---|---|---|---|
| A1 0188087 | 7/1986 | European Pat. Off. . | |
| A2 0271458 | 6/1988 | European Pat. Off. . | |
| 3150235 | 6/1983 | Fed. Rep. of Germany | 343/700 MS |
| 59-16402 | 1/1984 | Japan | 343/700 MS File |
| 509182 | 2/1977 | U.S.S.R. | 343/769 |

OTHER PUBLICATIONS

J. S. Dahele et al, "Dual-Frequency Stacked Annular-Ring Microstrip Antenna", IEEE Transactions on Antennes & Propagation, vol. AP-35, No. 11, Nov. 11, 1987.

*Primary Examiner*—Michael C. Wimer

*Attorney, Agent, or Firm*—Sughrue, Mion, Zinn, Macpeak & Seas

[57] ABSTRACT

A diplexing radiating element comprising at least a first radiating element in which two radiating electrical currents flow which are spaced apart from each other, and at least one second element in which two radiating magnetic currents flow which are spaced apart from each other. The invention is particularly applicable to space telecommunications.

9 Claims, 5 Drawing Sheets

DIPLEXING RADIATING ELEMENT

The invention relates to a diplexing radiating element.

BACKGROUND OF THE INVENTION

Such a radiating element operates simultaneously in two frequency bands, which frequency bands may, in particular, be close together, and in each frequency band, the element is capable of generating two orthogonal polarizations: linear or circular.

The advantage of of such an element is that it provides good signal separation performance between one frequency band and the other, in particular when the bands are close together.

It may also be used in any waveguide element that needs to operate at two separate frequencies and requires compact excitation from a TEM line feed (e.g. a coaxial line, a three-plate line, or a microstrip).

In general, prior art systems capable of operating at two frequencies require:

either a wideband radiating element and a system of diplexing filters for rejecting one frequency band or the other;

or else the superposition of two types of radiating element each operating in its own frequency band. The further apart the radiating zones of these elements, the lower the coupling between them. They are therefore difficult to improve without increasing the dimensions of one or other of the radiating elements.

In the superposition case, there is a difference between the equivalent radiating areas and this is poorly adapted to a sampling antenna, for example.

The object of the invention is to mitigate these various drawbacks.

SUMMARY OF THE INVENTION

To this end, the present invention provides a diplexing radiating element comprising at least a first radiating element in which two radiating electrical currents flow which are spaced apart from each other, and at least one second element in which two radiating magnetic currents flow which are spaced apart from each other.

Advantageously, the radiating element of the invention comprises a first radiating element in the form of an annular ring constituted by a circular conductor strip, and a radiating element in the form of an annular slot constituted by a conductor constituting an upper plane, a conductive disk, and a reflecting plane that makes the radiation from the slot unidirectional. A first spacer, e.g. a dielectric spacer, separates the first and second radiating elements, and a second spacer, e.g. a dielectric spacer, separates the second radiating element from its reflecting plane.

Such a radiating element has the following advantages:

it is extremely compact, circular polarization is directly generated in this case from a TEM line for both frequency bands over a length which is shorter than one quarter of a wavelength;

it may be provided solely with longitudinal rear accesses, thereby enabling accesses to be coupled without additional coaxial cables to a TEM transmit and/or receive power splitter parallel to the direction of maximum radiation, which location may also contain quadrature-forming hybrid couplers;

the coupling between the elements is reduced by the choice of radiating elements used; and when the device is used for exciting a waveguide fed in fundamental mode, the equivalent radiating areas in both frequency bands are identical.

BRIEF DESCRIPTION OF THE DRAWINGS

Embodiments of the invention are described by way of example with reference to the accompanying drawings, in which.

Figure 1:
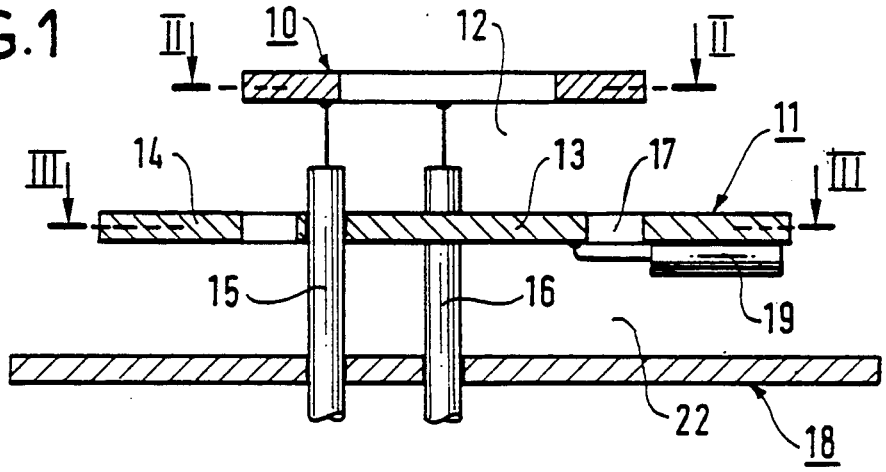
FIGS. 1, 2, and 3 are diagrams respectively in longitudinal section, in cross-section on plane II—II of FIG. 1, and in cross-section on plane III—III, showing one embodiment of a diplexing radiating element of the invention.
Figure 2:
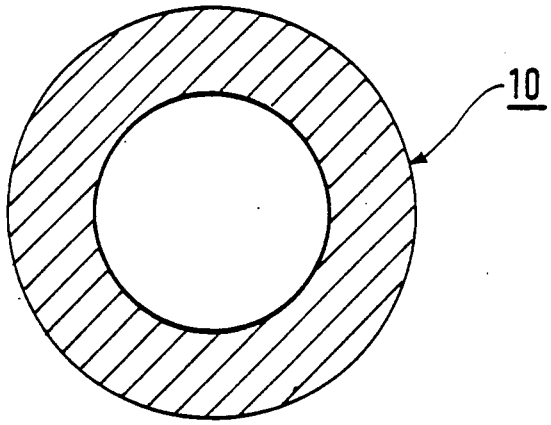
Figure 3:
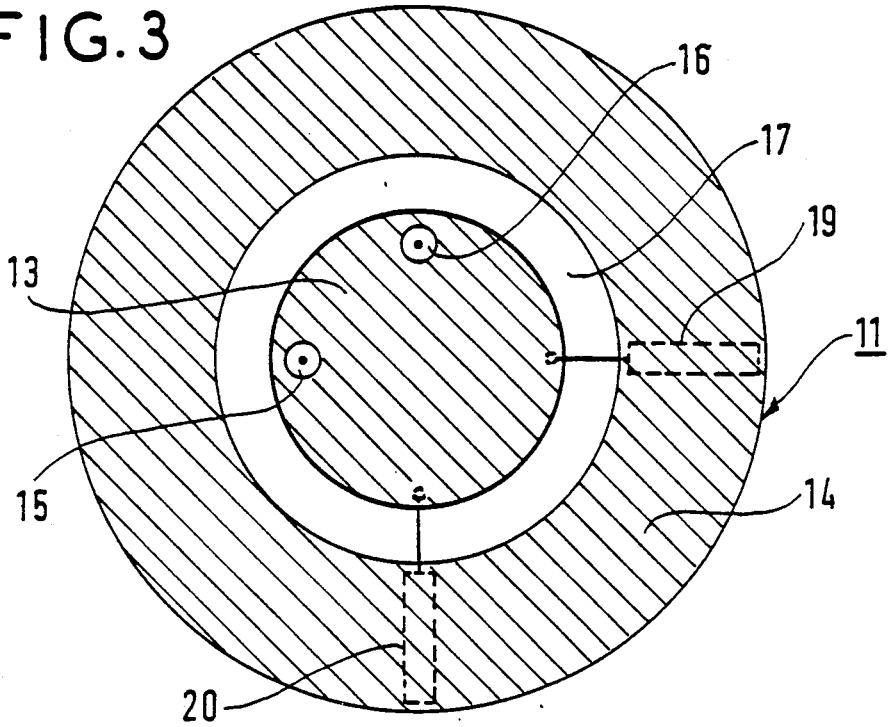

The diplexing radiating element of the invention as shown in FIGS. 1, 2, and 3 is constituted by two resonant radiating elements 10 and 11.

DETAILED DESCRIPTION

The first resonant radiating element 10 may be an annular ring constituted by a circular conductor strip, for example. Since this element operates in fundamental TM11 mode, the mean circumference of the strip is close to one wavelength. The metal strip may be obtained by chemical etching. A dielectric spacer 12 then separates it from metal conductors 13 and 14. These two conductors 13 and 14 are concentric, with the first conductor 13 being in the form of a disk and the second being in the form of a ring lying outside the first. The microwave source feeding the antenna 10 is connected to one, two, or four accesses which are separated from one another by rotation through 90°. The connection(s) may be coaxial as shown at 15 and 16, or may be of the microstrip type etched on the substrate 12, or may be provided by any other technique known to the person skilled in the art for feeding the antenna 10.

The second resonant radiating element 17 is an annular slot constituted by a conductor 14 constituting an upper ground plane, by the disk 13, and by a reflecting plane 18 making the radiation from the slot unidirectional. The gap between the conductors 13 and 14 constitutes the said annular slot 17. The conductors 13, 14, and 18 may be obtained by chemical etching on a substrate disposed in the gap 22, for example.

Figure 4:
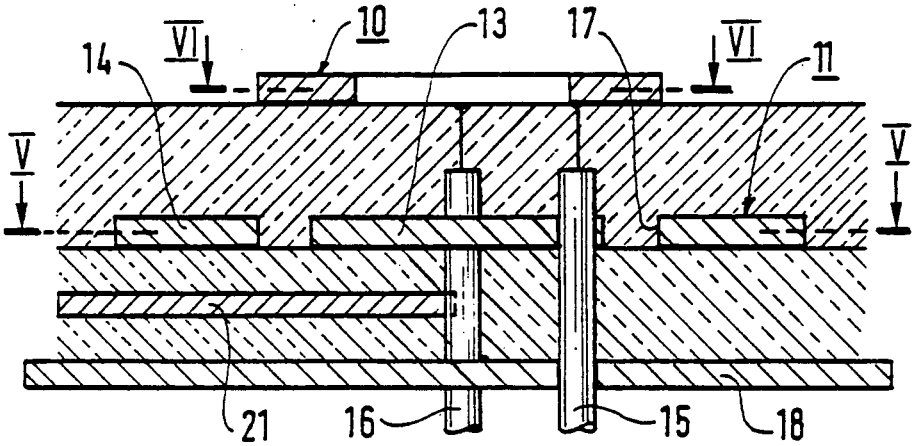
FIGS. 4 and 5 are respectively a longitudinal section and a cross-section through another embodiment of a diplexing radiating element of the invention.
Figure 5:
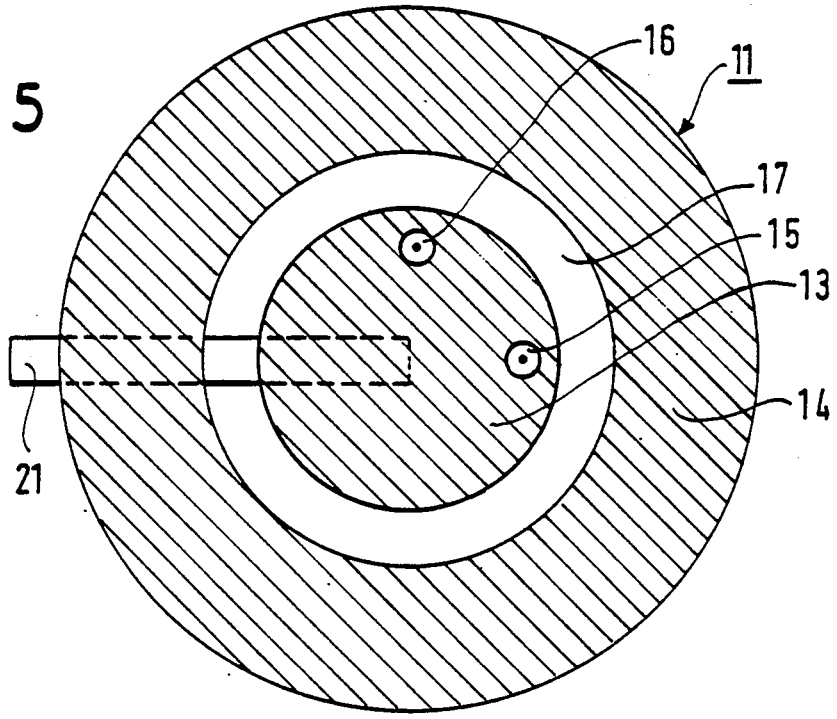

The antenna 17 may be fed in conventional manner, in particular by means of coaxial connections 19 and 20, or by a three plate line 21 (or microstrip) as shown in FIGS. 4 and 5. Feed then takes place without making contact.

The mean circumference of the slot 17 is of the same order as one wavelength.

In order to eliminate any possible potential difference between the conductors 18 and 14, electrical connections via metal studs or screws may be disposed around the slot 17;

When the antenna 10 is fed by a coaxial line, an access passage must be provided through the various thickness of substrate and/or conductor (accesses 15 and 16 when there are two acesses, passing through conductors 18 and 13 and through substrates 22 and 12). These connections tend to neutralize the electric field that would appear between the conductors 13 and 18 and do not significantly disturb the operation of the slot 17.

Figure 6:
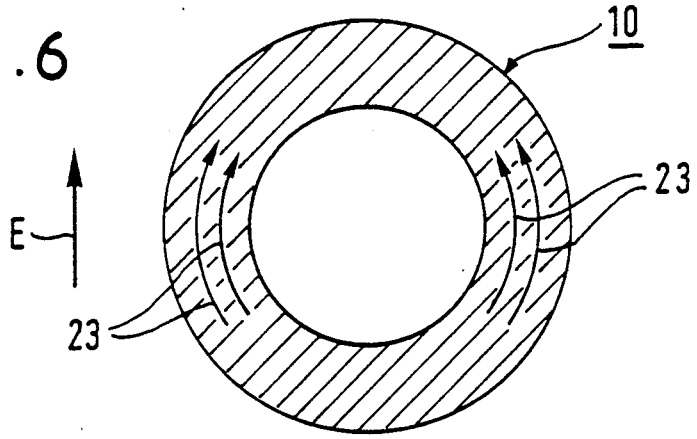
FIGS. 6 and 7 are views for explaining the operation of a diplexing radiating element of the invention.

FIG. 6 shows radiating electrical currents 23 in the antenna 10 together with the excited main polarization of the electric field E. The active currents are disposed on either side of the axis of symmetry in TM11 mode.

Figure 7:
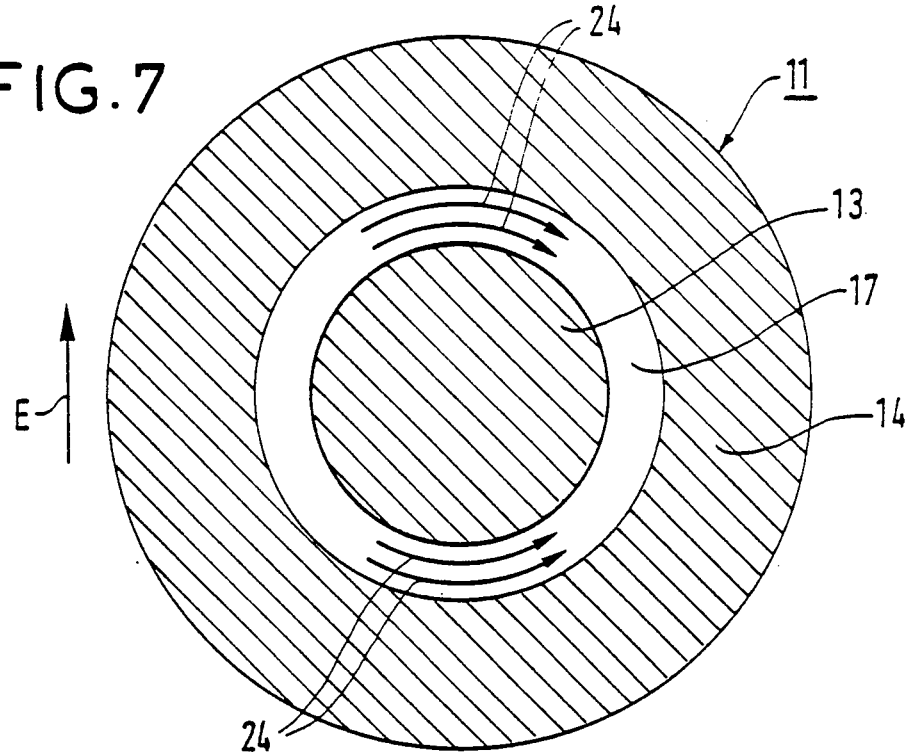

FIG. 7 shows the magnetic radiating currents of the antenna 17 together with the excited main polarization. In contrast to the above case, the active currents 24 are disposed along the axis of symmetry for a field radiated in the same direction as before.

By virtue of the nature and the disposition of the radiating currents 23 and 24 of the antennas 10 and 17, coupling between the two antennas is minimal, which constitutes one of the advantages of the invention. The antennas 10 and 17 thus have areas which are very similar, with similar radiating performance, while nevertheless presenting minimum coupling between the feed lines to the two antennas.

The various accesses can be matched to a selected impedance and the passband can be widened using conventional techniques of modifying:

the width of the metal strip 10 and the width of the slot 17;

the thicknesses of the spacers 12 and 22;

the dielectric natures of the spacers 12 and 22; and the electrical characteristics of the lines feeding the antennas 10 and 17.

In another embodiment of the invention, an annular slot and a circular patch are used. The antenna 10 is then a resonant circular disk antenna.

Figure 8:
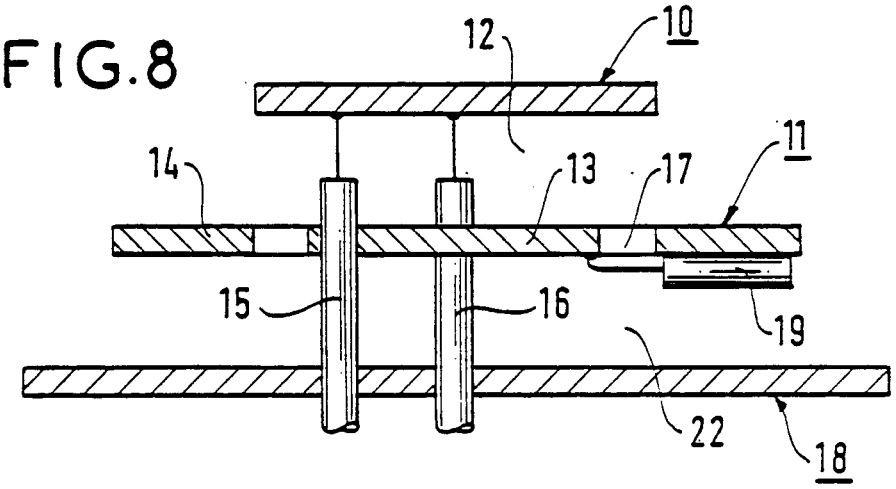
FIGS. 8 and 9 are a longitudinal section through a variant embodiment of the diplexing radiating elements of the invention together with a view explaining its operation.

FIG. 8 is a section through such a device. This device facilitates adjusting the matching of the antenna 10 by displacing the connections 15 and 16 towards the center of the disk.

Figure 9:
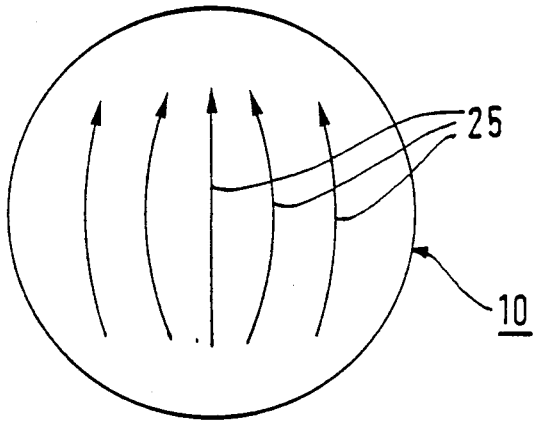

FIG. 9 shows the radiating currents 25 that occur in such an antenna 10.

In another embodiment of the invention, an annular slot is used in conjunction with a dipole. The antenna 10 may advantageously be replaced by a single or crossed dipole which may be printed or made of wires. The antenna is excited using conventional techniques.

Figure 10:
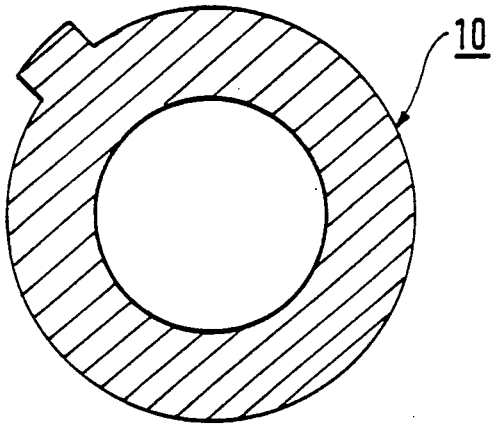
FIGS. 10, 11, and 12 show several variant embodiments of the diplexing radiating element of the invention.
Figure 11:
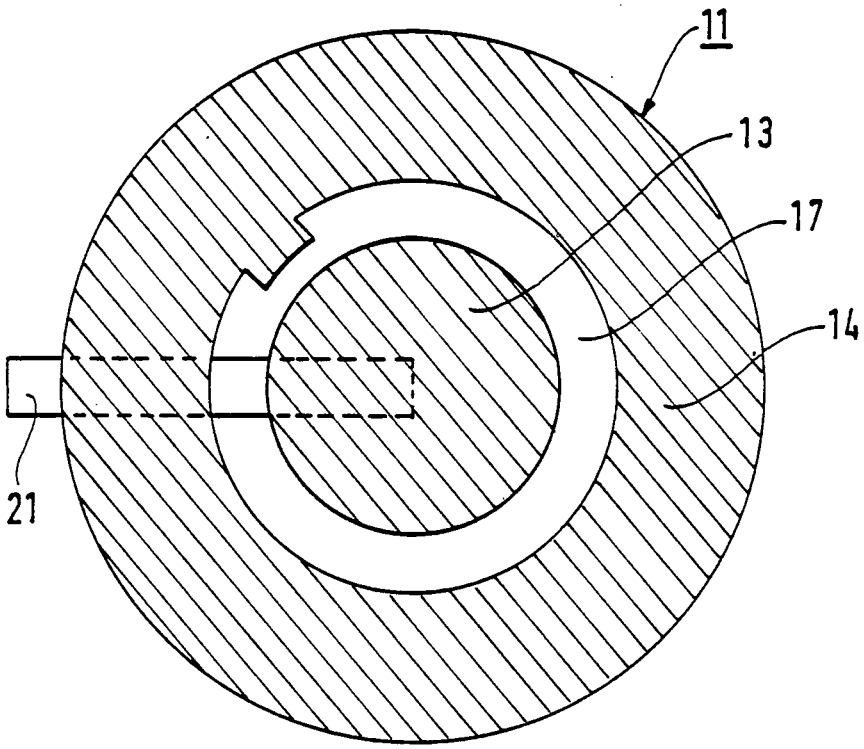

In another embodiment of the invention, circular polarization is generated by an access: when the specified frequency bands are narrow enough, the circular polarization generated by one or both of the antennas may be obtained by making one or both of the antennas asymmetrical using techniques conventional in the art (ears or notches) as shown in FIGS. 10 and 11, respectively.

Independently of the positioning of the antenna 17 relative to the antenna 10, the device is then advantageously usable when the directions of circular polarization of the radiated electromagnetic waves are identical. Coupling between the two antennas is then minimal.

Figure 12:
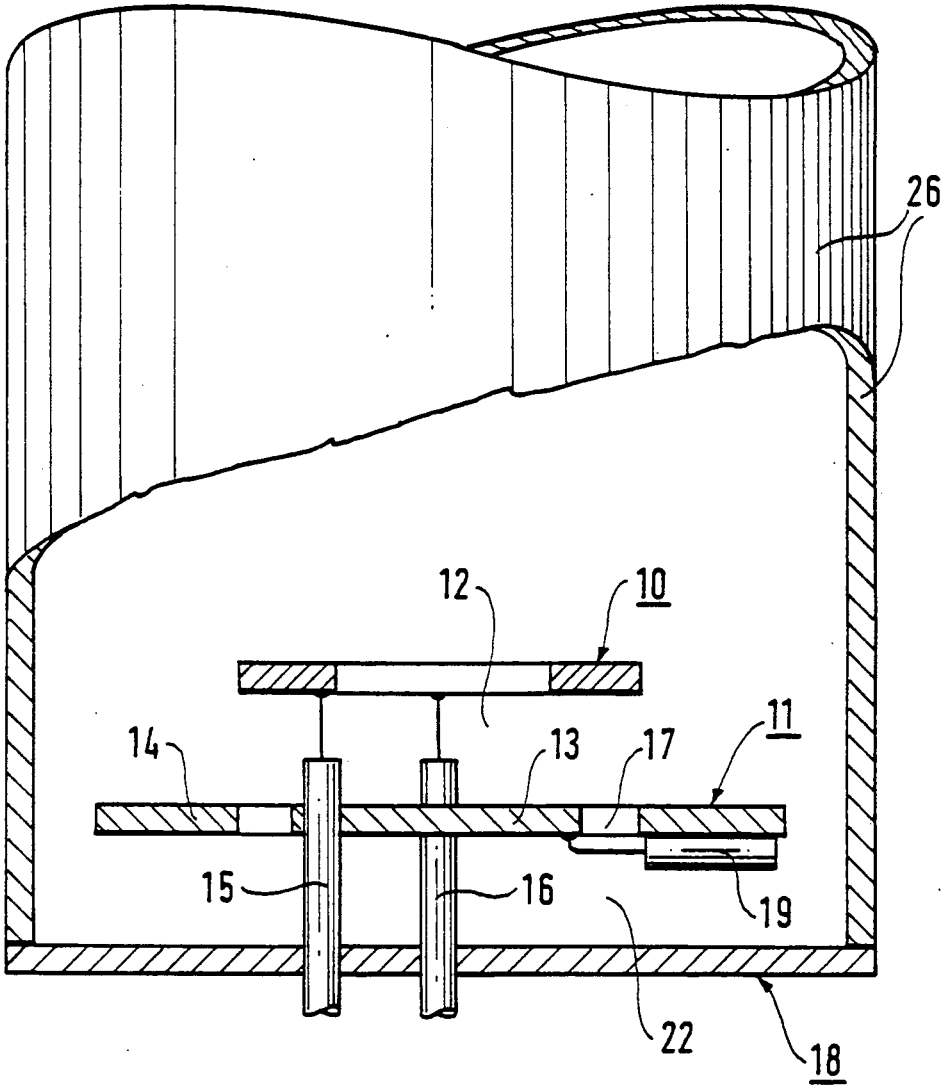

Any of the above-described embodiments of the device may advantageously be used for exciting two waves at different frequencies in a waveguide 26 as shown in FIG. 12. This device is particularly suitable when the waves are circularly polarized in the same direction, with wave ellipticity being generated by irregularities in the antennas or by feeds via two or four accesses using couplers at 0° and 90°, or at 0°, 90°, 180°, and 270°.

Naturally, the present invention has been described and shown merely by way of preferred example and its component parts could be replaced by equivalents without thereby going beyond the scope of the invention.

Thus, the waveguide could be circular, hexagonal, elliptical, or square.

Thus, the antennas 10 and 17 could be square, elliptical, or rectangular in shape: an antenna of one shape may be associated with an antenna of a different shape, one type of feed may be used in association with a different type of feed.

Band widening may be obtained by stacking non-fed radiating elements, by increasing the complexity of the matching circuit.

The device may be associated with pre-existing devices in order to constitute a three-band element, a four-band element, etc. . . . .

An array antenna may be made by grouping together various radiating elements as described above.

We claim:

1. A diplexing radiating device comprising: a first resonant radiating element and a second resonant radiating element, said resonant radiating elements operating in different frequency bands; said first radiating element including only one conductor; said second radiating element including a first conductor surrounding a second conductor and defining a slot therebetween; a microwave source being connected to at least one access feeding the first radiating element; said slot being fed by at least one line; said first conductor of the second radiating element constituting a ground plane; a reflector-plane causing the radiation from the slot to be unidirectional; and said diplexing radiating device being a stack consisting of:

said first resonant radiating element;

a first spacer;

said first and second conductors of the second resonant radiating element;

a second spacer; and said reflector-plane; whereby the coupling between said two resonant radiating elements is minimal.

2. A diplexing radiating device according to claim 1, wherein the first radiating element has the form of an annular ring constituted by a conductive strip which is circular in shape.

3. A diplexing radiating device according to claim 1, wherein the second radiating element is an annular slot.

4. A diplexing radiating device according to claim 1, wherein the spacers are dielectric spacers.

5. A diplexing radiating device according to claim 1, wherein a microwave source feeding the first radiating element is connected to at least two accesses offset from each other by rotation through 90°.

6. A diplexing radiating device according to claim 1, wherein the first radiating element is a circular resonant antenna.

7. A diplexing radiating device according to claim 1, disposed in a waveguide for exciting said waveguide.

8. A diplexing radiating device according to claim 1, having generated waves polarized in one of linear and circular polarizations, and in at least one direction.

9. An array antenna comprising a group of diplexing radiation devices, each of said diplexing radiation devices comprising: a first resonant radiating element and a second resonant radiating element, said resonant radiating elements operating in different frequency bands;

said first radiating element including only one conductor; said second radiating element including a first conductor surrounding a second conductor and defining a slot therebetween; a microwave source being connected to at least one access feeding the first radiating element; said slot being fed by at least one line; said first conductor of the second radiating element constituting a ground plane; a reflector-plane causing the radiation from the slot to be unidirectional; and said diplexing radiating devices each being a stack consisting of:

said first resonant radiating element;

a first spacer;

said first and second conductors of the second resonant radiating element;

a second spacer; and said reflector-plane; whereby the coupling between said two resonant radiating elements is minimal.

* * * * *